US009841199B2

(12) United States Patent
Lee

(10) Patent No.: US 9,841,199 B2
(45) Date of Patent: Dec. 12, 2017

(54) DROPLET EVAPORATION BASED SELF-CLEANING HUMIDIFICATION DEVICE

(71) Applicant: FEMTOFAB CO., LTD., Pohang-si (KR)

(72) Inventor: Sanghyun Lee, Pohang (KR)

(73) Assignee: FEMTOFAB CO., LTD., Pohang-si (KR)

( * ) Notice: Subject to any disclaimer, the term of this patent is extended or adjusted under 35 U.S.C. 154(b) by 28 days.

(21) Appl. No.: 14/908,796

(22) PCT Filed: Jul. 31, 2014

(86) PCT No.: PCT/KR2014/007071
§ 371 (c)(1),
(2) Date: Jan. 29, 2016

(87) PCT Pub. No.: WO2015/016644
PCT Pub. Date: Feb. 5, 2015

(65) Prior Publication Data

US 2016/0187015 A1 Jun. 30, 2016

(30) Foreign Application Priority Data

Jul. 31, 2013 (KR) ..... 10-2013-0090559

(51) Int. Cl.

| | |
|---|---|
| ***F24F 6/04*** | (2006.01) |
| ***B01F 3/04*** | (2006.01) |
| ***F24F 6/10*** | (2006.01) |
| *F28F 19/00* | (2006.01) |

(52) U.S. Cl.
CPC ..... *F24F 6/105* (2013.01); *B01F 3/04* (2013.01); *F24F 6/04* (2013.01); *F24F 6/10* (2013.01); *F28F 19/00* (2013.01); *F28F 2245/04* (2013.01)

(58) Field of Classification Search
CPC ..... B01F 3/04; F24F 6/04; F24F 2006/008
USPC ..... 261/141, 142, 78.2
See application file for complete search history.

(56) References Cited

U.S. PATENT DOCUMENTS 6,531,206 B2 * 3/2003 Johnston ..... E04F 15/02161 428/166
6,874,771 B2 * 4/2005 Birdsell ..... F24F 6/10 261/131

FOREIGN PATENT DOCUMENTS

| | | | |
|---|---|---|---|
| JP | 2002174440 | A | 6/2002 |
| JP | 2008104936 | A | 5/2008 |
| KR | 100928907 | B1 | 11/2009 |

* cited by examiner

*Primary Examiner* — Robert A Hopkins
(74) *Attorney, Agent, or Firm* — Fox Rothschild LLP

(57) ABSTRACT

Disclosed herein is a self-cleaning evaporation type humidification apparatus. The self-cleaning humidification apparatus is a floating drop evaporation type humidification apparatus of a new concept using a super hydrophobic surface, which provides safe humidification and does not require maintenance and repair, such as cleaning, by naturally or forcedly evaporating floating drops through control of the floating drops in the super hydrophobic surface based on the self-cleaning function, virus reproduction inhibition function, and water-repellant function of the super hydrophobic surface.

5 Claims, 7 Drawing Sheets

【Fig.1】
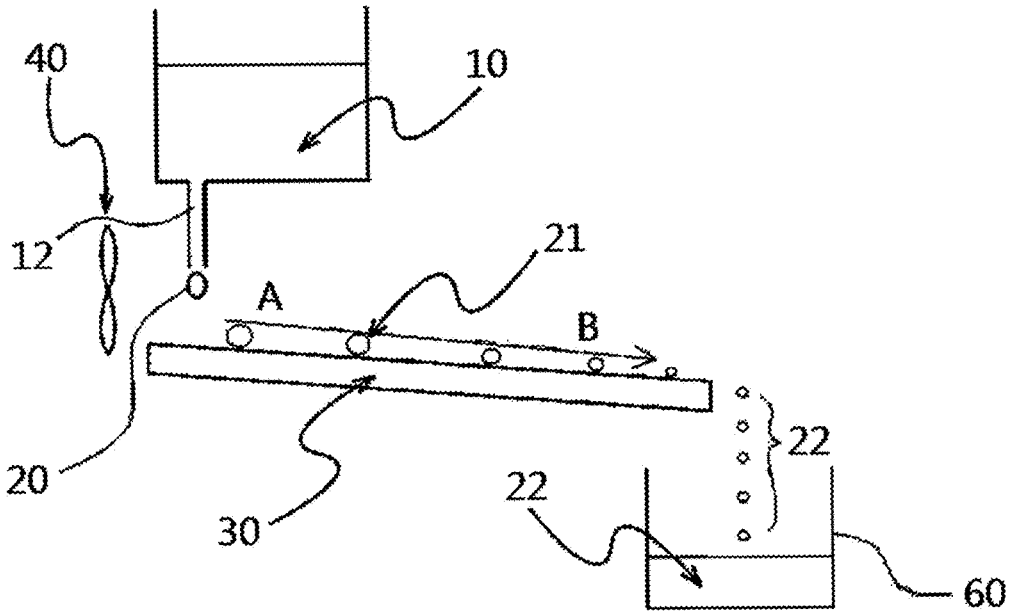
【Fig. 2】
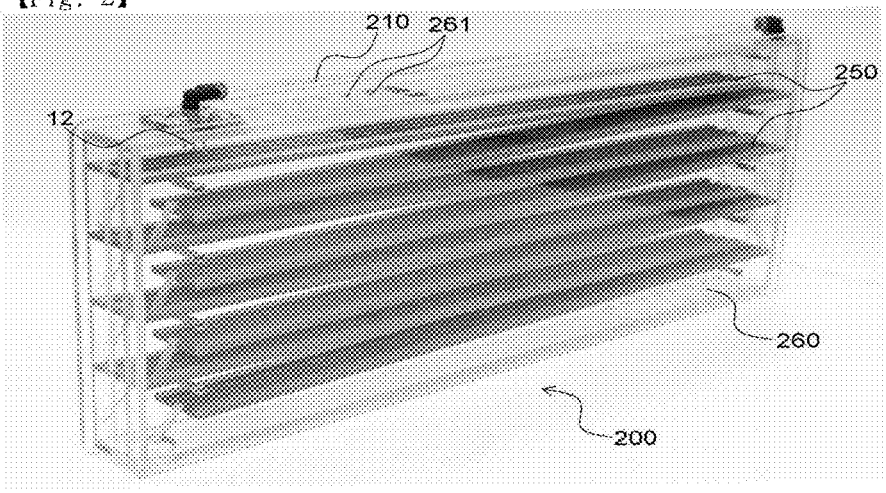

【Fig. 3】
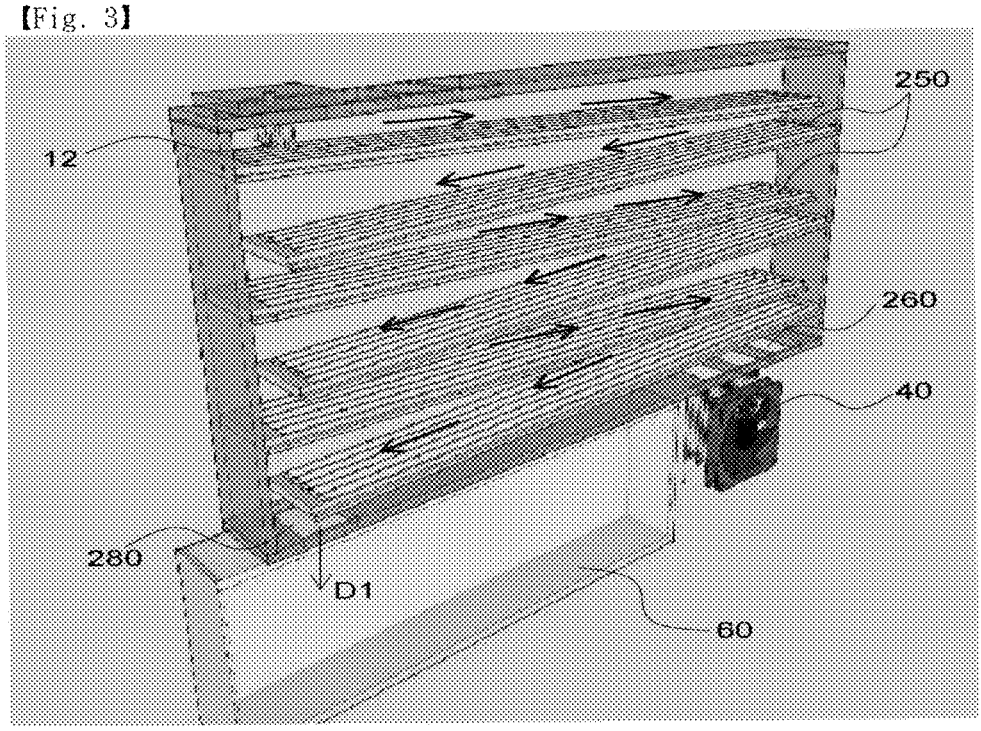
【Fig.4】
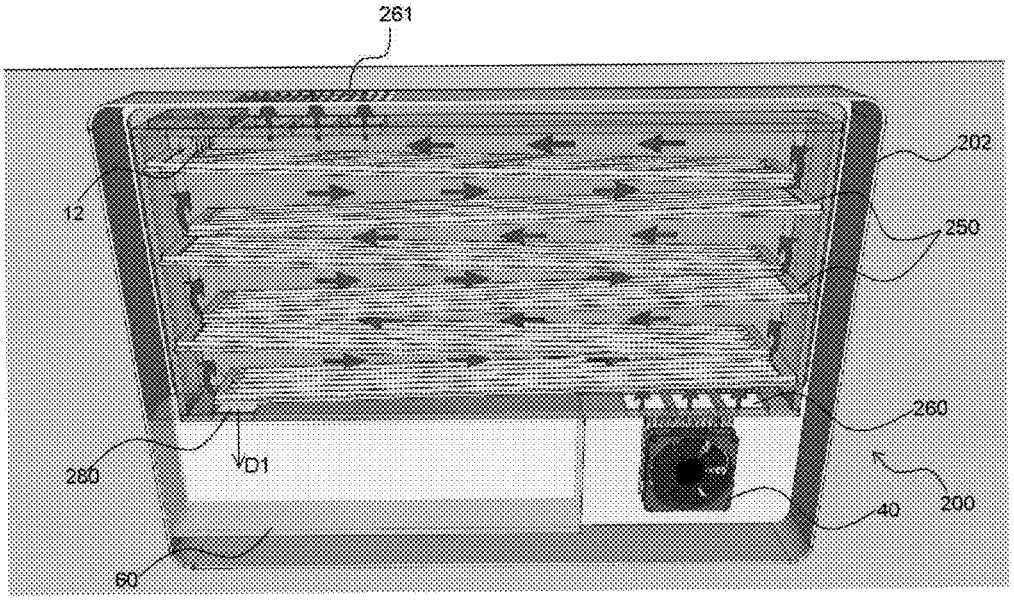

【Fig.5】
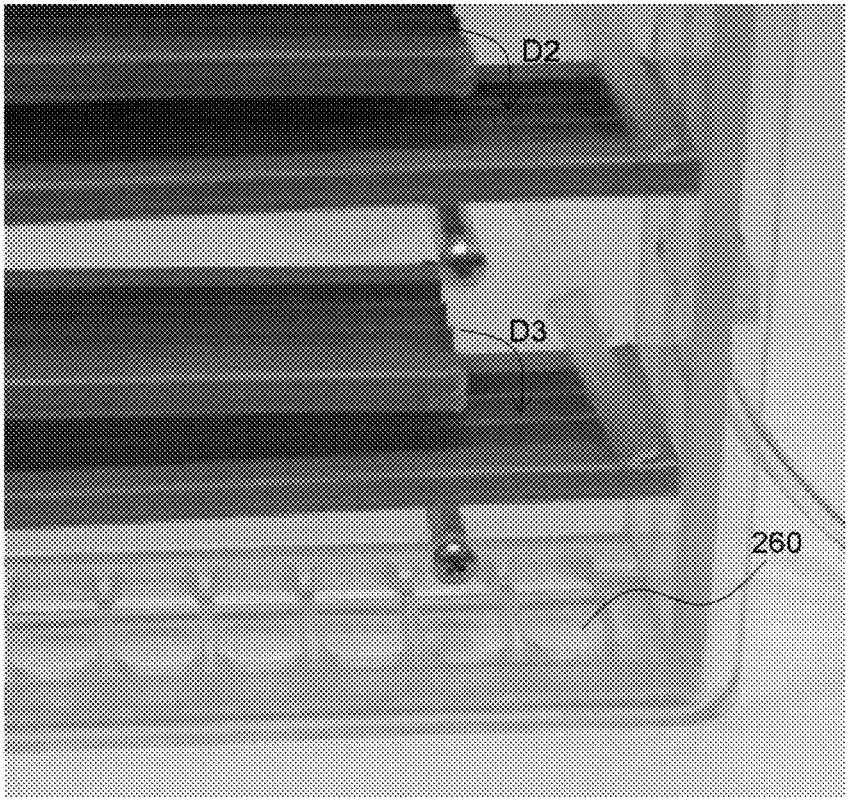
【Fig.6】
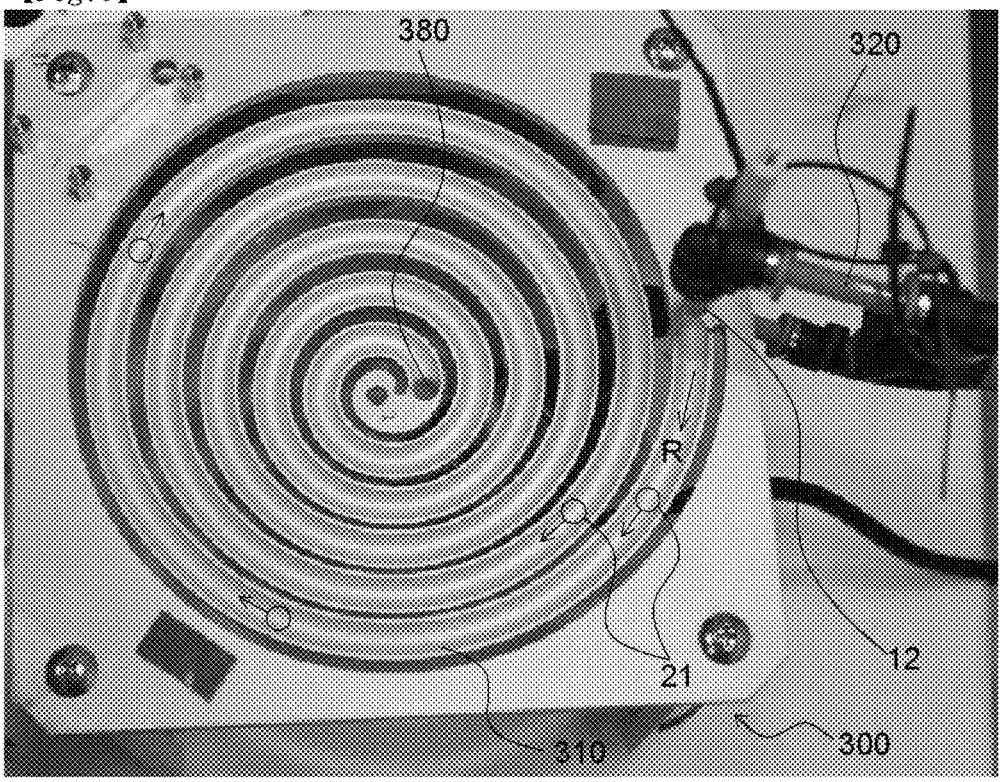

【Fig.7】
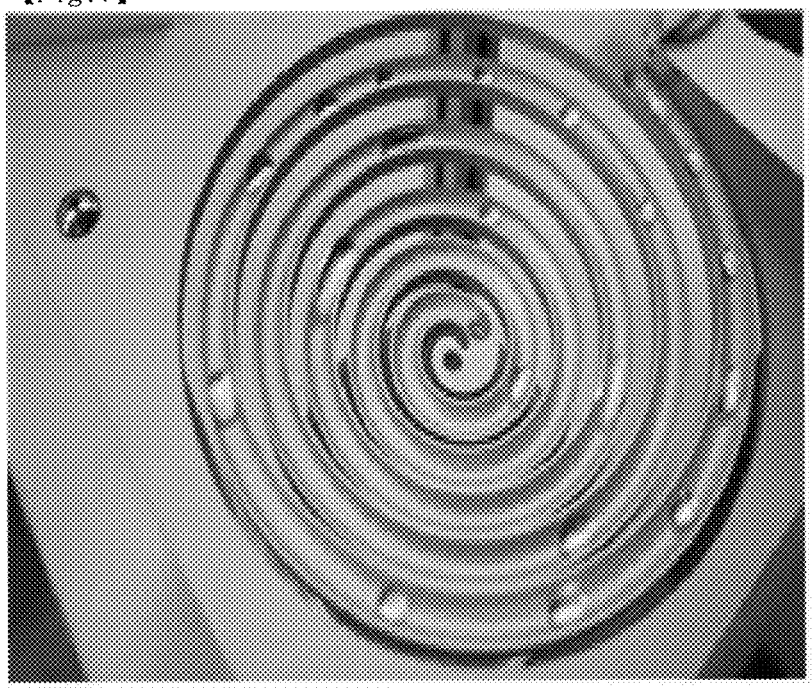
【Fig.8】
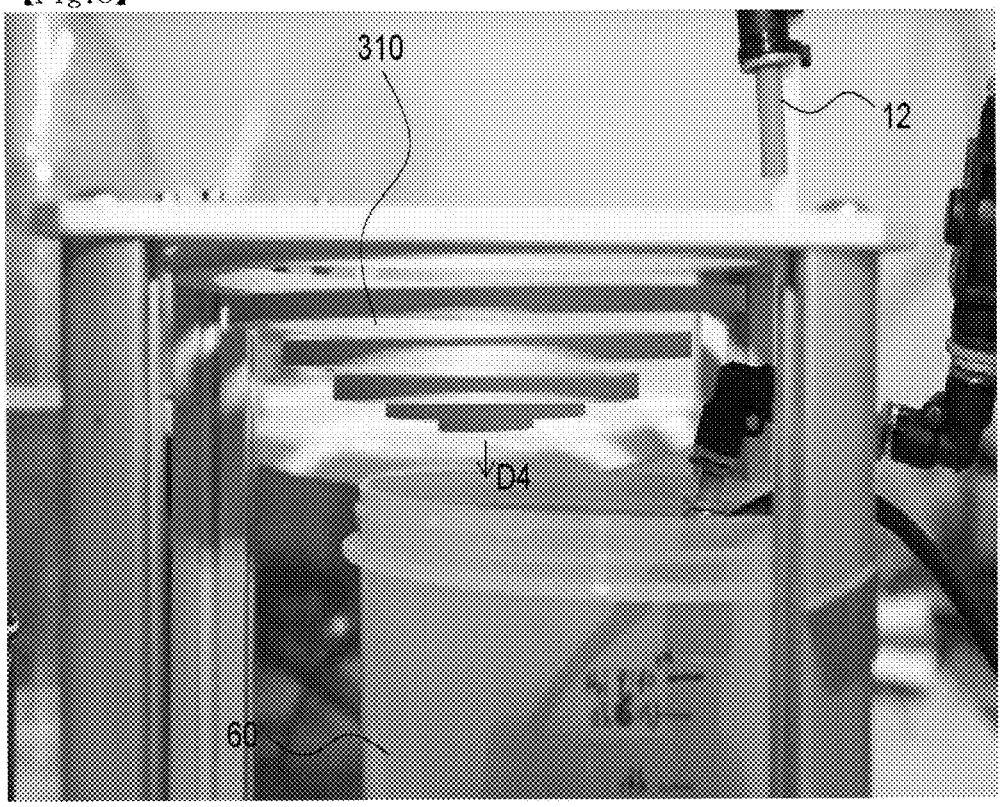

【Fig.9】
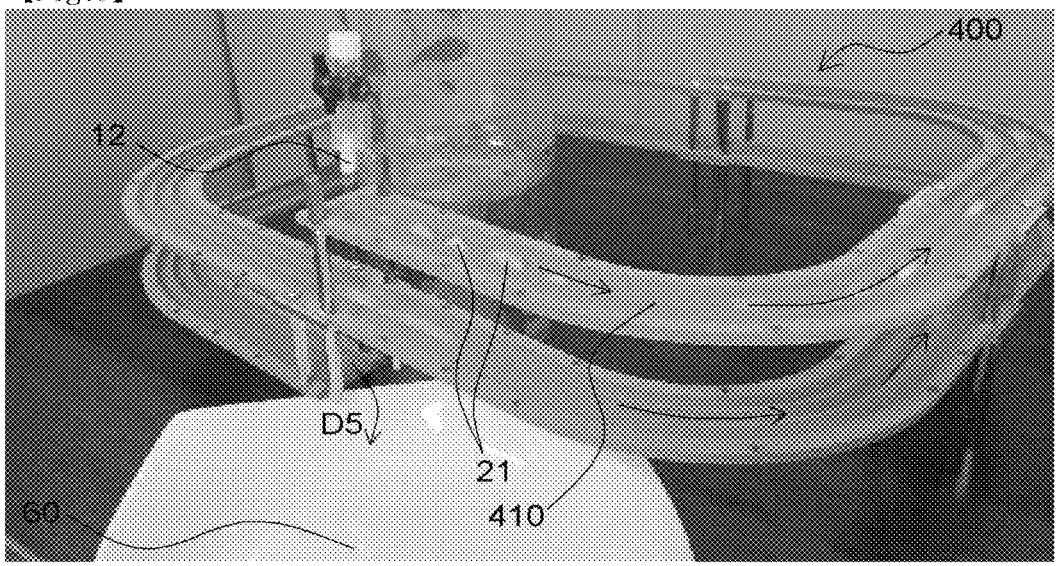
【Fig.10】
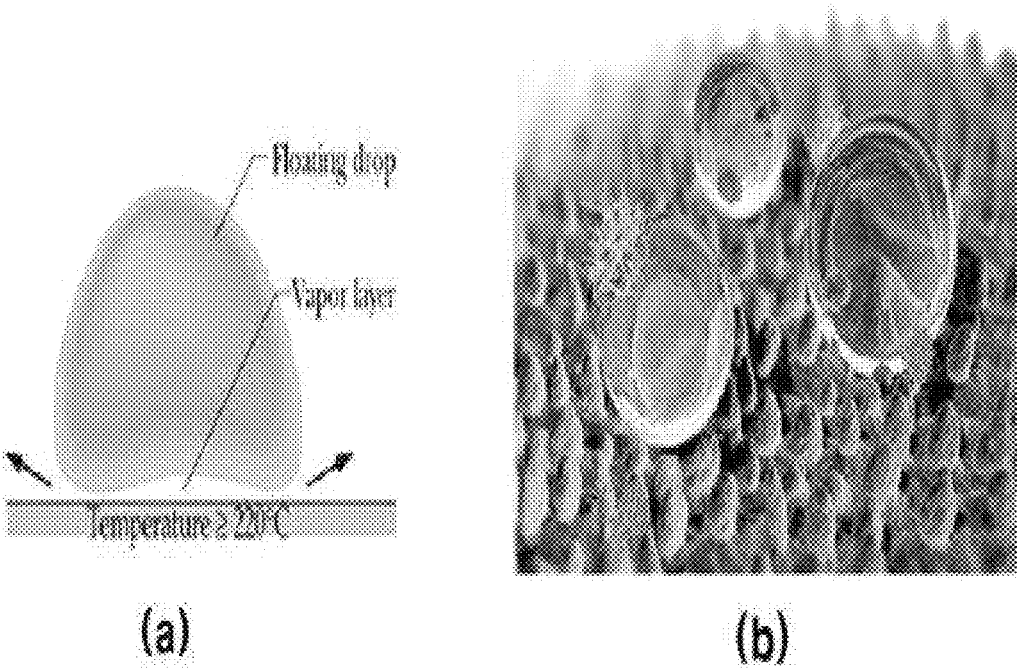

【Fig. 11】
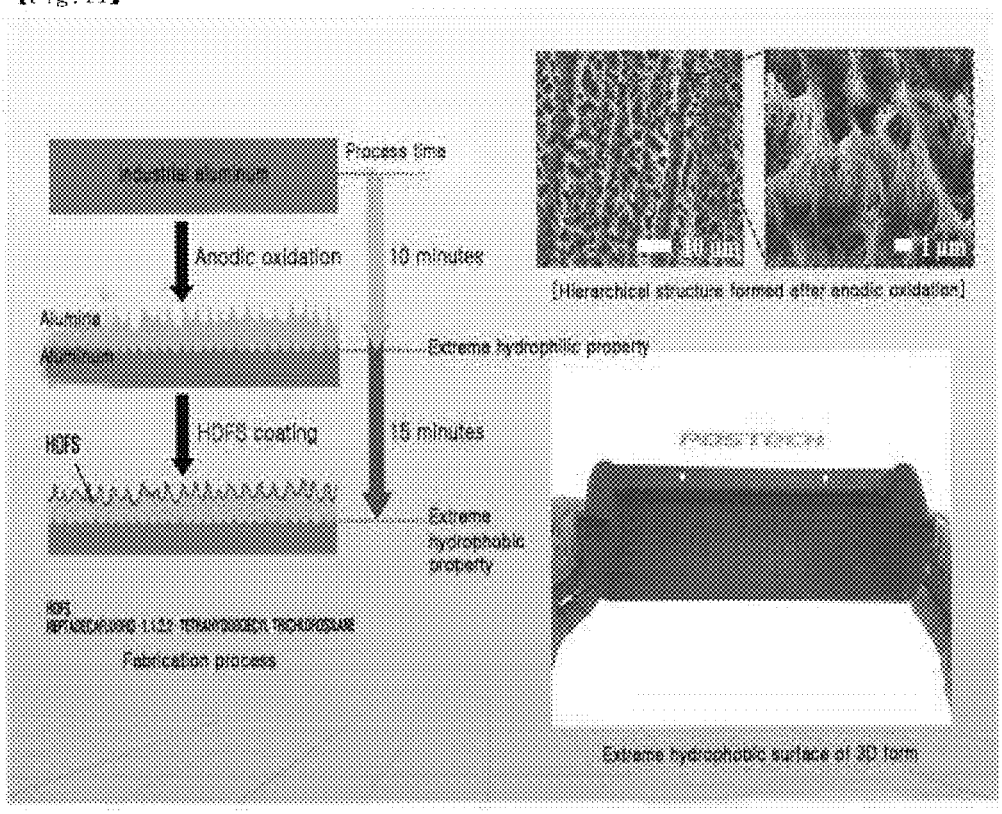

【Fig. 12】
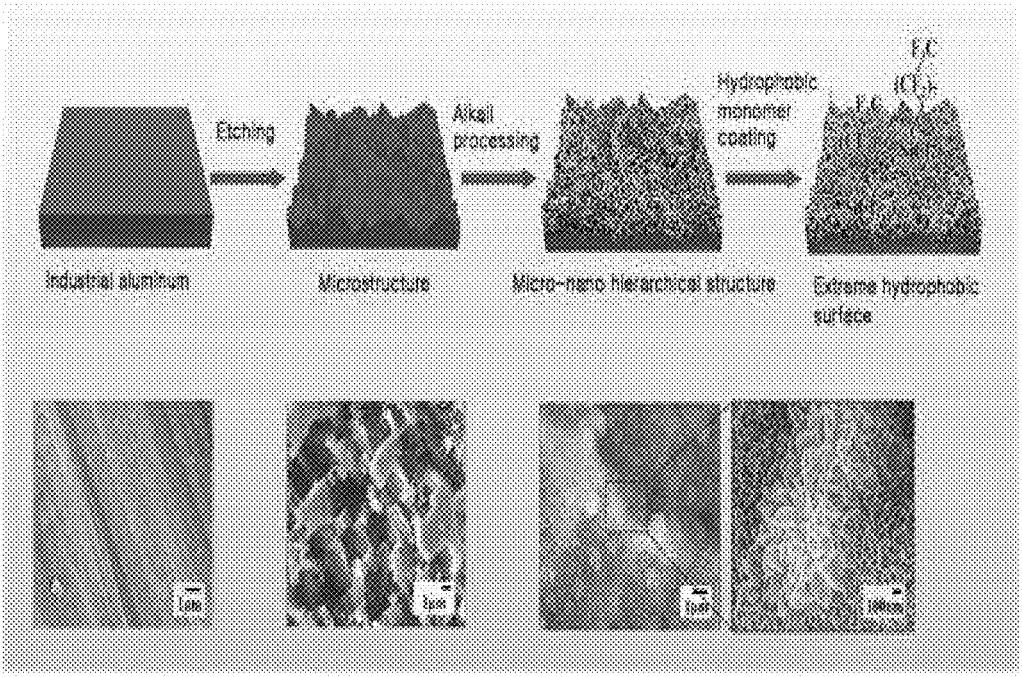

DROPLET EVAPORATION BASED SELF-CLEANING HUMIDIFICATION DEVICE

CROSS-REFERENCE TO RELATED APPLICATIONS

This application is the U.S. National Phase of International Application No. PCT/KR2014/007071, filed Jul. 31, 2014, which claims the benefit of Korea Patent Application No. 10-2013-0090559, filed Jul. 31, 2013, the disclosures of which are incorporated herein by reference.

TECHNICAL FIELD

The present invention relates to a humidifier capable of self-cleaning and, more particularly, to a humidifier technology in which a self-cleaning function has been implemented through a super water-repellant induction phenomenon or a super water-repellant coating surface based on a technology for evaporating and controlling floating drops.

BACKGROUND ART

A humidification apparatus having control of humidity as a main function is required for a pleasant life of the human being and is essential to prevent a variety of types of diseases and to maintain health. In Korea, the volume of a household humidifier market approaches 100 billons won, and the global market volume of the household humidifier approaches several trillion won. Accordingly, the household humidifier of home appliances has a relatively large market volume compared to low recognition. In particular, alternate product markets, such as charcoal and natural evaporation devices, are significantly increased due to chronic problems and inconvenience, such as a safety problem and the difficulty of cleaning and management in existing humidification apparatuses. This reveals that the humidifier is not simple taste consumer goods, but daily consumer goods. In particular, people's interest in health and well-being is increased as economy is advanced, and an individual interest and investment in a pleasant environment are increased in order to prevent diseases and to lead a healthy life as a burden of a medical cost is increased. This is significant in the humidifier market. In China, the humidifier market tends to be remarkably increased.

The humidifier is basically divided into a cold mist method for direct spraying vapor using ultrasonic waves/nozzle, a warm mist method for spraying vapor by heating, and an evaporation type for natural humidification through the forced circulation of air to an evaporation plate having a wide surface area.

A direct spray method, such as an ultrasonic humidification method, is advantageous in that maintenance is relatively easy because residues rarely remain in a humidification module and power consumption is low, but is problematic in that health it may be fatal to health because compounds of calcium, heavy metals and/or virus remaining in water is introduced into air. In particular, germicides are used for sterilization because virus is directly sprayed into air when the virus is reproduced. A germicide accident in the ultrasonic humidifier, which lost the life of several tens of the old and the infirm and infants in 2011 and gave us a great shock, speaks volume about a problem of the direct humidification method. The sterilization components of humidifier germicides chiefly include polyhexamethylene guanidine (PHMG), oligo(2-)ethoxy ethoxyethyl guanidine chloride (PGH), and methylchloroisothiazolinone (CMIT). Such materials are used for various products, such as shampoo and water tissues, because they have skin toxicity which is about 1 of a 5~10 percentage point compared to other germicides, but no sanction was not applied to the materials until victims were generated because research had not been carried out on toxicity generated when the materials were inhaled by a respiratory organ. In the case of PHMG and PGH, related companies suffered punishments after the harmfulness of PHMG and PGH was proven in clinical tests, and the distribution of all humidifier germicides was stopped. In U.S.A., Europe, and China in which many compounds of calcium is present in tap water, the problem of the ultrasonic humidifier has already come to the fore because compounds of calcium included in water are sprayed into air in a fine dust form apart from the germicide problem.

In contrast, the heating type humidifier is advantageous in that it has a sterilization action because water is heated to a high temperature and humidified and it is sanitary because a variety of types of alien substances, such as compounds of calcium included in water, are rarely introduced into air. However, the heating type humidifier is very inconvenient because residues in water adhere to a heating plate after pure water is supplied and thus the heating plate must be periodically cleaned. In particular, if many compounds of calcium are included in tap water as in U.S.A., Europe, and China, solid compounds of calcium are thickly deposited on the heating plate even after use of several days, and it is very inconvenient to remove the compounds of calcium deposited on the heating plate.

An evaporation type humidifier of an air wash type in which several tens of disks overlap to widen a surface area and humidification is performed by forcedly circulating air recently gains great popularity. Like the ultrasonic humidifier, the evaporation type humidifier has a concern about virus reproduction, but is relatively safe because alien substances, such as virus or compounds of calcium, are not introduced into air. However, such a kind of humidifier has disadvantages in that a stack structure of several tens of disks for widening a surface area of an evaporation plate makes it difficult cleaning and maintenance and the amount of humidification is relatively low. In order to supplement such disadvantages, strong air circulation needs to be generated using a fan, which may lead to a noise problem. Furthermore, a special detergent is used to clean an evaporation disk stack module. There is an evaporation type humidifier using a disposable module without using the evaporation disks due to the difficulty of such cleaning. All of existing humidification apparatuses on the market do not satisfy both the core elements "safety" and "cleaning and maintenance."

DISCLOSURE

Technical Problem

An object of the present invention is to provide a humidification apparatus, in which it can perform a function for solving disadvantages of the conventional humidifiers at a stroke because separate cleaning is not necessary because vapor is evaporated and supplied to the air and also alien substances do not adhere to a surface of an evaporation plate and all of various harmful materials are collected by the final falling water and simply discarded, there is no concern about harmful materials to be inhaled by the human body because floating drops themselves are not sprayed, and there is no concern about molds and/or other virus to be inhabited because floating drops continue to move.

Technical Solution

A humidification apparatus according to an embodiment of the present invention may include an evaporation plate for being supplied with water, water supply means for supplying the water to a surface of the evaporation plate, water movement means for moving the water supplied to the surface of the evaporation plate from one side of the evaporation plate to the other side thereof, evaporation acceleration means for accelerating the evaporation of the water on the surface of the evaporation plate, and water discharge means formed at the location where the movement of the water is terminated in the evaporation plate.

The water movement means may move floating drops on the surface of the evaporation plate from one side to the other side by moving water by gravity or forcedly ventilating the fan.

The evaporation acceleration means may be a heater for heating the evaporation plate, a fan for forcedly moving air around the surface of the evaporation plate, or an infrared radiation device or microwave radiation device for supplying radiation heat to the water on the surface of the evaporation plate.

The surface of the evaporation plate may be made of aluminum subjected to super water-repellant processing, or the evaporation plate may be heated so that floating drops (or droplets) have a very small contact area with the surface of the evaporation plate. Accordingly, the floating drops can move on the surface of the evaporation plate by a small force.

Advantageous Effects

The humidifier according to an embodiment of the present invention is advantageous in that it can function to solve disadvantages of the conventional humidifiers at a stroke because separate cleaning is not necessary because vapor is evaporated and supplied to the air and also alien substances do not adhere to a surface of an evaporation plate and all of various harmful materials are collected by the final falling water and simply discarded.

Furthermore, there is no concern, such as the fatal accidents in the conventional humidifiers, because floating drops themselves are not sprayed. Furthermore, there is no concern about molds and other virus to be inhibited because floating drops continue to move.

DESCRIPTION OF DRAWINGS

FIG. 1 is a schematic diagram illustrating the concept of the present invention.

FIGS. 2 to 5 are diagrams illustrating the structure of a step type humidifier according to a first embodiment of the present invention.

FIGS. 6 to 8 are diagrams illustrating the structure of a spiral type humidifier according to a second embodiment of the present invention.

FIG. 9 is a diagram illustrating the structure of a track type humidifier according to a third embodiment of the present invention.

FIGS. 10*a*, 10*b* and 11 are diagrams illustrating a super water-repellant surface.

FIG. 12 is a diagram showing a super water-repellant processing method for an aluminum surface using a known etching method.

MODE FOR INVENTION

Hereinafter, embodiments of the present invention are described in detail with reference to the accompanying drawings.

A humidification apparatus according to an embodiment of the present invention may include an evaporation plate for being supplied with water, water supply means for supplying the water to a surface of the evaporation plate, water movement means for moving the water supplied to the surface of the evaporation plate from one side of the evaporation plate to the other side thereof, evaporation acceleration means for accelerating the evaporation of the water on the surface of the evaporation plate, and water discharge means formed at the location where the movement of the water is terminated in the evaporation plate.

The evaporation plate of the water movement means is inclined with respect to a horizontal surface and is capable of moving floating drops on the surface of the evaporation plate from one side to the other side using gravity means for moving water by gravity or by forcedly ventilating air by driving the fan toward water although the evaporation plate is horizontal.

The evaporation acceleration means may be a heater for heating the evaporation plate, a fan for forcedly moving air around the surface of the evaporation plate, or an infrared radiation device or microwave radiation device for supplying radiation heat to the water on the surface of the evaporation plate.

The surface of the evaporation plate may be made of aluminum subjected to super water-repellant processing, or the evaporation plate may be heated so that a contact area between floating drops (or droplets) and the surface of the evaporation plate is very small. Accordingly, the floating drops can move on the surface of the evaporation plate even by a small force.

FIG. 1 is a schematic diagram illustrating the concept of the present invention. FIGS. 2 to 5 are diagrams illustrating the structure of a step type humidifier according to a first embodiment of the present invention. FIGS. 6 to 8 are diagrams illustrating the structure of a spiral type humidifier according to a second embodiment of the present invention. FIG. 9 is a diagram illustrating the structure of a track type humidifier according to a third embodiment of the present invention. FIGS. 10 and 11 are diagrams illustrating a super water-repellant surface.

Referring to FIG. 1, the humidifier according to an embodiment of the present invention may include a water tank 10, that is, water supply means for supplying water, a motor device (not shown) for supplying water from the water tank, a control device (not shown) for controlling the amount of supplied water, a pipe device (not shown), a valve (not shown), and a nozzle 12.

The droplets of supply water 20, that is, water supplied from the water tank 10 to a surface of an evaporation plate 30, are evaporated while moving on the surface of the evaporation plate 30 from a direction A to a direction B. Accordingly, the size of a floating drop is gradually reduced.

In this case, the droplets (or floating drops) of the moving water 21 flowing on the surface of the evaporation plate 30 can be moved by a very small force because they maintain a very small contact area with the surface of the evaporation plate 30. After the water of the droplets is sufficiently evaporated while moving, it results in falling water 22 having a small size. The falling water containing a variety of types of contaminants, such as dust, drops to a collection container 60.

Alien substances, such as compounds of calcium, heavy metals, and virus included in the floating drops, do not remain on a surface of the evaporation plate 30 because only the pure water component of the moving water 21 is evaporated while the moving water 21 moves on the surface of the evaporation plate 30.

Furthermore, the humidifier according to an embodiment of the present invention also functions as a self-cleaning humidifier for the evaporation plate 30 itself because alien substances on the surface of the evaporation plate 30 are collected by the floating drops of the moving water 21 due to the strong surface tension of water. In other words, the humidifier according to an embodiment of the present invention plays the role of a very sanitary humidifier because harmful materials are contained in the floating drops and the floating drops become the falling water 22 and collected.

In other words, there are advantages in that separate cleaning is not required because floating drops are forced to roll over, vapor is evaporated and supplied to the air, and alien substances do not adhere to the surface of the evaporation plate 30 and the disadvantages of a conventional humidifier can be solved at a stroke because all of a variety of types of harmful materials are collected by the final falling water 22 and simply discarded. Furthermore, there is no concern about a fatal accident, such as that in a conventional humidifier, because floating drops themselves are not sprayed, and there is no concern about molds and other virus to be inhabited because floating drops continue to move.

The surface of the evaporation plate 30 and floating drops need to continue to have a narrow contact area. To this end, in an embodiment of the present invention, the surface of the evaporation plate 30 has a super water-repellant surface. As shown in FIG. 10, a contact area between a floating drop and the surface of the evaporation plate 30 processed to have a super water-repellant surface is very small. Accordingly, the floating drop can move by a small force.

FIG. 10(*b*) shows an example in which floating drops are formed a lotus. The floating drop has a form close to a sphere. FIG. 10(*a*) shows a Leidenfrost phenomenon.

Referring to FIG. 10(*a*), when a floating drop is placed on a surface heated at 200° C. or more, a vapor layer is generated between the floating drop and the surface of the evaporation plate 30. In this case, the floating drop moves on the surface by a very small external force.

Water and the surface of the evaporation plate 30, 250, 310, or 410 according to an embodiment of the present invention need to maintain the state of FIG. 10(*a*) or 10(*b*).

If the state of FIG. 10(*a*) is to be maintained, a heater (not shown) needs to be formed in the evaporation plate in order to heat water.

In some embodiments, a contact area between the floating drops of FIG. 10(*b*) and the surface may be greatly reduced by applying super water-repellant surface processing on which active research is carried out to the surface of the evaporation plate.

A super water-repellant surface processing technology has been developed into methods for forming a mixed form of the microstructure and nanostructure of a lotus leaf through simulations in various ways.

The reason why a surface having a mixture of the microstructure and the nanostructure generates a super water-repellant phenomenon is that water does not get wet into such a fine structure due to the strong surface tension of water. Accordingly, the solid surface and water maintains a stably separated state on the basis of a very thin air layer. This is a super water-repellant phenomenon in which the solid surface does not get wet. In this case, water is dropped in a floating drop form and rolls over the super water-repellant surface almost without a friction. Such a state is described as a Wenzel stage and a Cassie state and has been established as a super water-repellant basis theory.

The following method may be applied to a method for forming the surface of the evaporation plate into the super water-repellant surface. That is, a first example in which an aluminum surface is formed into the super water-repellant surface is as follows. In an embodiment of the present invention, one of known super water-repellant surface processing methods is used, and the present invention is not limited to a specific method.

When an electric current flows into aluminum by applying a potential in the state in which aluminum is put into an electrolyte solution using an anodic oxidation process method, a surface of aluminum is changed into a fine structure form having a mixture of a microstructure and a nanostructure. When water-repellant coating processing, such as HDFS, is performed on the fine structure, the super water-repellant surface that does not extremely get wet is formed. An embodiment of the present invention is applied to a humidifier by applying an existing method for forming the super water-repellant surface.

FIG. 11 shows an example of the method for performing super water-repellant processing on the aluminum surface using the anodic oxidation processing method.

A second example in which the super water-repellant surface is formed is an etching method not using electricity. The etching method is a recent method for obtaining a microstructure by processing an aluminum surface using an acid solution and additionally generating a nanostructure by alkali processing. The etching method is advantageous in terms of processing speed and the price because electricity is not used.

FIG. 12 shows a super water-repellant processing method for an aluminum surface using a known etching method.

In addition, there is a template scooping-up method using a surface having a micro/nanostructure. Coating methods for coating micro and nanoparticles on a surface by spraying the micro and nanoparticles are commercialized in various ways. It is expected that more stable and cheaper super water-repellant surface processing methods will be suggested in the future.

An embodiment of the present invention suggests a technology regarding a humidifier structure equipped with the evaporation plate to which the super water-repellant surface processing method has been applied.

First Embodiment

FIGS. 2 to 5 are diagrams related to the first embodiment. A step type humidifier 200 includes the evaporation plate 250 having multi-staged plates formed on a horizontal surface at a specific angle. The nozzle 12 for supplying water is installed on one side of an evaporation plate 250 at the top layer. Furthermore, a collection container 260 for collecting the falling water is formed at the bottom of the housing. The water tank is omitted, for convenience sake.

Means for accelerating the evaporation of floating drops moving on the evaporation plate 250 may be a heater for heating the evaporation plate 250, a fan for forcedly moving air around the surface of the evaporation plate 250, an infrared radiation device or microwave radiation device for supplying radiation heat to the water on the surface of the evaporation plate 250, or a combination of two or more of them.

Water supplied by the nozzle 12 goes down in zigzags along the inclined evaporation plate 250. Vapor evaporated while the water moves on the surface of the evaporation plate 250 is ventilated by a fan 40 and thus moves in an arrow direction of FIG. 4. That is, the arrow direction of FIG. 4 denotes the direction in which vapor moves. The vapor exits through vapor outlets 261 at the top of the housing, thus playing the role of the humidifier.

The evaporation plate 250 according to an embodiment of the present invention is different from that of the embodiment of FIG. 1 in that the evaporation plate 250 is formed of multi-staged plates as shown in FIG. 3.

Water flows down along the inclined surface of the evaporation plate 250 by gravity in the arrow direction of FIG. 3. The water finally becomes falling water in a direction D1 and is collected by the collection container 60. In the present embodiment, the length of the evaporation plate 250, that is, the time that floating drops stay on the surface of the evaporation plate, is very long compared to the embodiment of FIG. 1. Accordingly, moisture components contained in the floating drops are discharged through a water outlet 280 after they are sufficiently evaporated.

As described above, the surface of the evaporation plate may be formed into the super water-repellant processing surface. In some embodiments, a heater (not shown) may be installed in another evaporation plate in order to heat another evaporation plate at about 200° C. In this case, a vapor layer is formed between floating drops and the surface of the evaporation plate (refer to FIG. 10) so that the floating drops well roll over the surface of the evaporation plate.

For reference, a housing 202 of FIG. 4 is omitted in FIG. 3. FIG. 2 is a photograph in which the collection container 60 and fan 40 of the elements shown in FIG. 3 are omitted.

FIG. 5 is a photograph of part of the multi-staged evaporation plate of FIG. 3. The inclined end of each evaporation plate has a structure for dropping to a next evaporation plate (i.e., directions D2 and D3). Furthermore, the surface of each evaporation plate may be configured in a round groove form so that water on the surface of the evaporation plate does not flow down to the outside, as shown in FIG. 5.

The gradient and width of the evaporation plate and the number of multi-staged evaporation plates are not limited to specific numerical values. The humidifier according to the present embodiment may further include a fan for forcedly moving water on the surface of the evaporation plate. In some embodiments, an infrared radiation device or microwave radiation device for inducing the acceleration of the evaporation of water itself may be installed near the evaporation plate.

The humidifier of the present embodiment is advantageous in that it can be easily fabricated in a wall-mountable type and can be mass-produced.

Second Embodiment

The present embodiment has a form, such as the evaporation plate 310 shown in FIGS. 6 to 8.

FIG. 8 is a side view of the humidifier, and FIG. 7 shows that floating drops actually flow on the evaporation plate 310.

The humidifier of the present embodiment may be called a spiral type and has a structure in which floating drops flow down along a curved surface of a spiral form from top to bottom. Such a structure has advantages in that a narrow space can be used, the path of floating drops moving on the surface of the evaporation plate can be increased, and a unique and beautiful appearance can be obtained.

The moving water 21, that is, water supplied through a water supply pipe 320 and the nozzle 12, flows down while rotating on the surface of the evaporation plate 310 in an R direction. The size of floating drops is gradually reduced as the moisture components of the water are evaporated, and the floating drops finally fall through a water outlet 380 placed at the central part of FIG. 8.

As in the first embodiment, the surface of the evaporation plate 310 may be subjected to super water-repellant coating processing or a heater for supplying heat may be formed on a surface of the evaporation plate 310.

The inclination and diameter of the evaporation plate 310 are not limited to specific numerical values. The humidifier of the present embodiment may further include a fan for forcedly moving water on the surface of the evaporation plate 310. In some embodiments, an infrared radiation device or microwave radiation device for inducing the acceleration of the evaporation of water itself may be installed near the evaporation plate 310.

Third Embodiment

FIG. 9 shows another example of the evaporation plate according to the third embodiment. The evaporation plate 410 according to the third embodiment is basically similar to that of the second embodiment. The diameter of the evaporation plate 410 according to the present embodiment is not reduced, but the evaporation plate 410 is formed in a track type and has a structure in which short-distance athletics tracks overlap in several layers.

The track type is advantageous in that the water tank can be installed in the empty space at the center of the evaporation plate 410 and the moisture components of floating drops can be sufficiently evaporated because the moving path of moving water is increased on the same width condition compared to the spiral type.

Water supplied by the humidification apparatus according to the embodiments of the present invention may be applied to both a floating drop form and a flowing water form.

EXPLANATION OF REFERENCE NUMERALS

D1, D4, D5: Discharge direction of water
10: Water tank 12: Nozzle
20: Supply water 21: Moving water 22: Falling water
30: Evaporation plate
40: Fan
60: Collection container
200: Step type humidifier 202: Housing
210: Water supply pipe
250: Evaporation plate
260: Air flow port
261: Vapor outlet
280: Water outlet
300: Spiral type humidifier
310: Evaporation plate
380: Water outlet 400: Track type humidifier

The invention claimed is:

1. A self-cleaning humidification apparatus based on droplet evaporation, comprising:

an evaporation plate for being supplied with water;

water supply means for supplying the water to a surface of the evaporation plate;

water movement means for moving the water supplied to the surface of the evaporation plate from a first side of the evaporation plate to a second side of the evaporation plate;

evaporation acceleration means for accelerating an evaporation of the water on the surface of the evaporation plate; and water discharge means formed at a location where the movement of the water is terminated in the evaporation plate, wherein the evaporation acceleration means comprises a heater for heating the evaporation plate, a fan for forcedly moving air around the surface of the evaporation plate, an infrared radiation device or microwave radiation device for supplying radiation heat to the water on the surface of the evaporation plate, or a combination of two or more of the heater, the fan, and the infrared radiation device or microwave radiation device, and wherein the surface of the evaporation plate is made of super water-repellant-processed aluminum.

2. A self-cleaning humidification apparatus based on droplet evaporation, comprising:

an evaporation plate for being supplied with water from a first side, having a surface of a specific inclination so that the supplied water moves by gravity;

water supply means for supplying water to a surface of the evaporation plate;

evaporation acceleration means for accelerating an evaporation of the water on the surface of the evaporation plate; and water discharge means formed at a location where the movement of the water is terminated in the evaporation plate, wherein the evaporation acceleration means comprises a heater for heating the evaporation plate, a fan for forcedly moving air around the surface of the evaporation plate, an infrared radiation device or microwave radiation device for supplying radiation heat to the water on the surface of the evaporation plate, or a combination of two or more of the heater, the fan, and the infrared radiation device or microwave radiation device, and wherein the surface of the evaporation plate is made of super water-repellant-processed aluminum.

3. The self-cleaning humidification apparatus of claim 1 or 2, wherein the heater heats the evaporation plate at 200° C. to 300° C. so that a vapor layer is formed between the surface of the evaporation plate and the water.

4. The self-cleaning humidification apparatus of claim 2, wherein the evaporation plate is configured to comprise a plurality of separated plates formed in plural layers in zigzags so that water flowing down along a plate at a higher layer drops to an end of a plate right under the plate at the higher layer.

5. The self-cleaning humidification apparatus of claim 2, wherein the evaporation plate is configured to have a spiral form or track form so that the evaporation plate is inclined from top to bottom.

* * * * *